US011732583B2

(12) United States Patent
Thomas et al.

(10) Patent No.: US 11,732,583 B2
(45) **Date of Patent: *Aug. 22, 2023**

(54) RETAINER DEVICE FOR A ROCK ANCHOR, ROCK ANCHOR SYSTEM AND ASSOCIATED INSTALLATION METHOD

(71) Applicant: JUSAND NOMINEES PTY LTD, Port Melbourne (AU)

(72) Inventors: Sam Thomas, Port Melbourne (AU); Gerry Noonan, Parkville (AU)

(73) Assignee: JUSAND NOMINEES PTY LTD, Port Melbourne (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/362,958

(22) Filed: Jun. 29, 2021

(65) Prior Publication Data

US 2021/0324739 A1 Oct. 21, 2021

Related U.S. Application Data

(63) Continuation-in-part of application No. 16/557,062, filed on Aug. 30, 2019, now Pat. No. 11,066,931.

(30) Foreign Application Priority Data

| | | |
|---|---|---|
| Aug. 31, 2018 | (AU) | 2018223042 |
| Mar. 28, 2019 | (AU) | 2019202151 |
| May 21, 2021 | (AU) | 2021203289 |

(51) Int. Cl.

| | |
|---|---|
| ***E21D 21/00*** | (2006.01) |
| ***E21D 20/00*** | (2006.01) |
| *E21D 20/02* | (2006.01) |

(52) U.S. Cl.

CPC ..... *E21D 21/0093* (2013.01); *E21D 20/00* (2013.01); *E21D 21/008* (2013.01);

(Continued)

(58) Field of Classification Search

CPC . E21D 21/004; E21D 21/0046; E21D 21/008; E21D 21/0093

(Continued)

(56) References Cited

U.S. PATENT DOCUMENTS

| | | | | |
|---|---|---|---|---|
| 4,147,458 A * | 4/1979 | Elders | ..... | E21D 21/008 411/33 |
| 4,453,845 A * | 6/1984 | Donan, Jr. | ..... | E21D 21/008 411/39 |

(Continued)

FOREIGN PATENT DOCUMENTS

| | | | | |
|---|---|---|---|---|
| CA | 2740943 A1 * | 2/2012 | ..... | E21D 21/008 |
| CN | 110055964 A * | 7/2019 | | |
| GB | 2073283 A * | 10/1981 | ..... | E21D 20/02 |

*Primary Examiner* — Frederick L Lagman
(74) *Attorney, Agent, or Firm* — Benjamin Hodges; Foster Garvey P.C.

(57) ABSTRACT

The present invention provides a retainer device 1 for retaining or holding an anchor rod 11 of a rock anchor, especially a self-drilling anchor, in a hole H drilled above horizontal. The retainer device 1 comprises: a body portion 2 configured to be mounted on the anchor rod 11, e.g., on an outer or external periphery of the anchor rod, and at least one locking arm or tab 6, 7 that projects from the body portion 2 in a direction transverse to a longitudinal extent of the anchor rod 11. The body portion 2 is configured to engage an abutment or shoulder on the outer or external periphery of the anchor rod to prevent its movement relative to the anchor rod 11 in use, and the at least one arm or tab 6, 7 is configured to deform so as to engage and bear against an inner wall W of the hole H when the retainer device 1 mounted on the anchor rod 11 is driven into the hole H. The invention also relates to a rock anchor system 10, compris- (Continued)

ing: at least one elongate anchor rod 11; a drill bit 12 configured for attachment to one end region 13 of the elongate anchor rod 11 for drilling the anchor rod 11 into rock strata R; and at least one retainer device 1 according to the invention described above for retaining or holding the anchor rod 11 in a hole H drilled in the rock strata R above horizontal. The invention also provides a method for installing a rock anchor.

25 Claims, 8 Drawing Sheets

(52) U.S. Cl.
CPC ..... *E21D 21/0046* (2013.01); *E21D 21/0053* (2016.01); *E21D 20/021* (2013.01); *E21D 20/025* (2013.01)

(58) Field of Classification Search
USPC ..... 405/259.1

See application file for complete search history.

(56) References Cited

U.S. PATENT DOCUMENTS 5,984,588 A * 11/1999 Ferrari ..... E21D 21/0026 405/269
6,102,118 A * 8/2000 Moore ..... E21B 17/1028 405/262
7,320,371 B2 * 1/2008 Mocivnik ..... E21D 21/0033 175/57
8,087,850 B2 * 1/2012 Craig ..... E21D 21/008 405/259.4
8,556,542 B2 * 10/2013 Horsch ..... E21D 21/0006 175/325.2
11,066,931 B2 * 7/2021 Thomas ..... E21D 21/0093
2004/0165958 A1 * 8/2004 McLaren ..... E21D 20/02 405/259.1
2005/0123361 A1 * 6/2005 Robertson, Jr. ..... E21D 21/008 405/259.4
2011/0274504 A1 * 11/2011 Spath ..... E21D 21/008 405/259.3
2012/0114426 A1 * 5/2012 Kenny ..... E21D 21/008 405/259.4
2015/0204152 A1 * 7/2015 Boehm ..... E21B 3/00 175/57
2016/0326873 A1 * 11/2016 Skogseth ..... E21D 20/02

* cited by examiner

RETAINER DEVICE FOR A ROCK ANCHOR, ROCK ANCHOR SYSTEM AND ASSOCIATED INSTALLATION METHOD

This application is a continuation-in-part of U.S. Pat. No. 11,066,931, the entire contents of which are incorporated herein by reference.

FIELD OF THE INVENTION

The present invention relates to a retainer device for a rock anchor, and particularly for retaining or holding an anchor rod of a rock anchor in a rock bore drilled above horizontal during installation. The present invention also relates to a rock anchor system including such a retainer device and a method of installing a rock anchor.

Thus, it will be appreciated that the present invention has particular application or use in the mining industry, and it will be convenient to describe the invention herein in that exemplary context. It will be noted, however, that applications may also be contemplated in other fields, such as in the construction industry.

BACKGROUND OF THE INVENTION

In underground mine environments, a body or vein of ore will typically be accessed by excavating cavities into the rock strata below the ore body or vein and then working towards the are deposit from below. This technique is referred to in the mining field as "overhand stoping" and has become the predominant direction of mining with the advent of rock blasting and power drills.

Depending on the quality of the rock strata excavated to access the are body, the rock from which the underground cavities are excavated may need to be stabilised with rock anchors to render the underground environment safe against the risk of rock-fall or even partial or total collapse. A known and regularly employed technique for stabilising rock strata in underground mines is with the use of cable bolts and rock anchors.

A cable bolt is a somewhat flexible steel cable (e.g. of nominal 15 mm diameter) which is grouted into a drilled hole. The length of the cable bolt will typically range from about 4 m to about 15 m depending on the particular rock condition (6 m is typical) and is installed in holes drilled above horizontal (i.e. "up holes"). The process of cable bolting involves drilling a hole into the rock, inserting a cable bolt into the hole, fixing the cable bolt in the hole with a cement gout, waiting for the grout to cure (typically a 12-hour minimum cure time), then tensioning the cable with a hydraulic jack at the fee end region of the cable outside the hole, and installing a plate and fixture at the external rock face. Cable bolts can be installed with a purpose-built drill rig known as a "cabolter" or can be installed with a drill rig known as a "jumbo". Both methods are time consuming and, in the case of installing with a jumbo, have inherent safety risks associated with the process.

A self-drilling rock anchor is a known alternative to cable bolts and other types of rock anchors and comprises one or more hollow threaded anchor rod or bar (each typically 2.5 m or 3 m in length), a drill bit that is mounted on a distal end of the anchor rod or bar, a coupling to join two or more anchor rods or bars together, and a plate and nut. The process of installing such a self-drilling anchor (SDA) involves: drilling a hole or bore into the rock with the SDA (e.g. using a "jumbo" drill rig) via the drill bit mounted at the distal end of the anchor rod; attaching additional lengths of SDA anchor rod as required; leaving the SDA in the hole or bore and injecting resin through the hollow centre of the anchor into the hole to fix the anchor rod of the SDA in the hole; allowing the resin to cure (usually only a matter of 5 to 10 minutes); then optionally tensioning the anchor rod at the free or proximal end region of the anchor rod outside the hole, and installing a plate and nut fixture on the exposed end of the SDA at the rock face.

Due to the fact that the anchor rod of an SDA is inserted as the hole or bore is drilled, a more efficient installation process is possible. Because resin can be used in the relatively small annular cavity surrounding the SDA anchor rod in the hole (i.e. instead of cement grout) and the resin is injected through the anchor rod, a consistent and reliable delivery of resin (or grout) is possible and the very faster-acting resin makes the use of SDAs attractive. Thus, self-drilling anchors (SDAs) of the type described above have the potential to replace the cable bolts and other types of rock anchors in range of situations. A remaining problem, however, is associated with the use of SDAs in holes or bores drilled above horizontal (i.e. in "up holes"). In particular, where additional lengths or sections of anchor rod are required (which is often the case), the initial length of anchor rod drilled into the rock has a tendency to fall out of the hole under self-weight before another section can be coupled to it. For this reason, SDAs are less practical and/or less commonly employed in holes or bores drilled above horizontal.

In view of the above, it is would be desirable to provide a new rock anchor system and a method for installing a rock anchor in a hole or bore drilled above horizontal.

SUMMARY OF THE INVENTION

According to one aspect, therefore, the present invention provides a retainer device for retaining or holding an anchor rod of a rock anchor, especially a self-drilling anchor, in a hole drilled above horizontal. The retainer device comprises: a body portion configured to be mounted on the anchor rod, especially on an outer or external periphery of the anchor rod, and at least one arm or tab that projects from the body portion in a direction transverse to a longitudinal extent of the anchor rod. The body portion is configured to engage an abutment or shoulder on the outer or external periphery of the anchor rod to prevent its movement relative to the anchor rod in use, and the at least one arm or tab is configured to deform so as to engage and bear against the inner surface of the hole when the retainer device mounted on the anchor rod is driven into the hole. In this way, when the at least one arm or tab deforms to engage and bear against the inner surface of the hole, it can operate to hold or "lock" the anchor rod in the "up-hole" such that it is not able to fall out under its self-weight. The at least one "arm or tab" is therefore also generally referred to herein as a "locking arm or tab". The retainer device may therefore enable safe and effective installation of an SDA in above horizontal holes.

In a preferred embodiment, the or each arm or tab is elongate and projects from the body portion transversely to the longitudinal extent of the anchor rod by a distance at least equal to a diameter of the anchor rod. The distance is preferably in the range of 2 to 10 times the diameter of the anchor rod, and more preferably in the range of 4 to 6 times the diameter of the anchor rod. The anchor rod will typically have a diameter in the range of about 20 mm to about 40 mm, and the at least one arm or tab will preferably project from the body portion by a distance in the range of about 100 mm to about 200 mm.

In a preferred embodiment, each armor tab is formed as a strip- or pin-like element and it projects generally radially outwardly from the anchor rod in use; e.g. like a prong. Thus, the at least one arm or tab has a substantially greater radial extent in its undeformed state than the diameter of the hole drilled for the anchor rod upon which the retainer device is mounted.

In a preferred embodiment, the at least one arm or tab is configured to deform resiliently and/or plastically to engage and bear against the inner surface of the hole when the retainer device mounted on the anchor rod is driven into the hole. Thus, if there is a plastic (i.e. permanent) deformation of the projecting arm or tab, there is preferably also at least some resilient deformation such that the arm or tab remains outwardly biased into engagement with the inner side of the hole. Such an outward bias assists the arm to support and hold the anchor rod in the drilled hole.

In a preferred embodiment, the body portion of the retainer device is, in use, configured for translational movement relative to the anchor rod along a longitudinal extent of the anchor rod. In this way, as the anchor rod of the SDA is rotated to drill the anchor rod into the rock strata to form a hole for receiving and securing the anchor rod, the retainer device is able to move relative to the anchor rod outside of the hole being drilled. For example, as the anchor rod progressively advances into the hole being drilled in the rock under the percussive and rotary action of a drill bit provided on the SDA, the retainer device may remain adjacent the outer rock face (i.e., outside of the hole) mounted on the outer periphery of the anchor rod.

In a preferred embodiment, the body portion is configured for sliding translational movement along the anchor rod. In this regard, the body portion typically comprises a profile that does not substantially interfere with sliding translational movement along the outer or external periphery of the anchor rod, even if the outer or external periphery of the anchor rod presents a helical thread. In particular, the body portion may include or define a channel for receiving the anchor rod and an inner periphery of the channel has or presents the profile that is sized or configured to allow sliding translational movement along the outer or external periphery of the anchor rod. For example, the body portion may be slidably received on the anchor rod via a clearance fit. In one example, the body portion may be configured as a sleeve member, wherein the profile comprises a generally cylindrical channel within the sleeve for receiving the anchor rod, the cylindrical channel being oversized with respect to an outer diameter of the anchor rod to provide such a clearance fit. In an alternative example, the cylindrical channel of the body portion may optionally be sized to engage lightly the outer or external periphery of the anchor rod (e.g., via a light friction fit or light interference fit) and yet may nevertheless be able to be slid in the axial direction along the anchor rod upon the application of a relatively low force.

In a preferred embodiment, the body portion is configured to be fixed or held against translational movement along the anchor rod when the retainer device mounted on the anchor rod is driven into the hole. In this way, the act of driving the anchor rod and the retainer device into the hole does not cause the retainer device to migrate along the length of the anchor rod. Instead, the body portion remains substantially fixed in the axial direction relative to the anchor rod, which thereby causes the at least one arm or tab to be deformed against the inner sides or walls of the drilled hole. In one possible embodiment, the body portion may include a clip or clamp mechanism that can be activated to grip the anchor rod against relative translational movement, and deactivated to release the anchor rod to allow relative translational movement. The clip or clamp mechanism may include a switch-type lever, a slide element, or a rotatable collar for activating and deactivating the clamp or, for example, a locking pawl. In another possible embodiment, an abutment is provided on the outer or external periphery of the anchor rod for engagement with the body portion to prevent its translational movement along the anchor rod. In this regard, the abutment may comprise a shoulder that projects radially from the outer or external periphery of the anchor rod. For example, the abutment or shoulder may comprise part of a coupling member that is configured to axially interconnect the anchor rod upon which the body portion of the retainer device is mounted with another anchor rod.

In a particularly preferred embodiment, the body portion comprises a coil, especially a helical coil. In this embodiment, the body portion and/or the at least one arm or tab is/are comprised of steel, such as spring steel. For example, the coil may be formed from steel wire having a diameter in the range of about 3 mm to about 20 mm, preferably about 6 mm.

In a preferred embodiment, the at least one arm or tab comprises a plurality of arms or tabs that project in a direction transversely outwards from a longitudinal extent of the anchor rod. For example, a first arm or tab may project from one end region of the body portion, and a second arm or tab may project from an opposite end region of the body portion. In an alternative arrangement, the first and second tabs or arms may project transversely outwards from the same end region of the body portion of the retainer device. The tabs or arms provided at the same end region of the body portion are preferably arranged evenly spaced apart from one another, such that where there are two tabs or arms at the same end region of the body portion, they preferably project transversely outwards in generally diametrically opposed directions.

According to another aspect, the invention provides a drill bit configured for attachment to an end region of an elongate anchor rod in a rock anchor system, the drill bit comprising a retainer device having at least one arm or tab that projects outwards in a direction transverse to a longitudinal extent of the anchor rod, the at least one arm or tab being configured to deform to engage and bear against an inner surface of a hole drilled by the drill bit as the retainer device is driven with the drill bit into the hole.

In a preferred embodiment, the retainer device comprises a body portion configured to be mounted on the drill bit, especially on an outer or external periphery of the drill bit. To this end, the body portion may include or define a channel for receiving a part of the drill bit. The body portion is preferably configured to engage an abutment or shoulder on the outer or external periphery of the drill bit. In another embodiment, the retainer device may be fixed to or rigidly attached to the coupling member. For example, a body portion of the retainer device could be fixed or rigidly attached to or integral with the drill bit.

Thus, the invention preferably provides a drill bit or drill bit assembly for a rock anchor system, the drill bit/assembly configured for attachment to an end region of an elongate anchor rod and comprising a retainer device according to any of the embodiments described above for retaining or holding the anchor rod in a hole drilled above horizontal.

In a preferred embodiment, the drill bit assembly comprises a socket portion configured for receiving and connecting with the end region of the elongate anchor rod, wherein the retainer device is mounted on an outer periphery of the socket portion. In this regard, the socket portion preferably comprises a sleeve member, such as a generally cylindrical sleeve member, having an internal thread for threaded engagement with an external thread on an outer periphery of the elongate anchor rod. The retainer device may therefore be provided on an outer periphery of the sleeve member. The sleeve member preferably includes an abutment, such as a flange, against which the body portion of the retainer device is configured to engage or abut. Alternatively, the body portion of the retainer device could be fixed or rigidly attached to or integral with the sleeve member of the drill bit.

According to yet another aspect, the invention provides a coupling member configured for interconnecting ends of two elongate anchor rods in a rock anchor system for substantial longitudinal alignment of the anchor rods, the coupling member comprising a retainer device having at least one arm or tab that projects outwards in a direction transverse to a longitudinal extent of the coupling member or anchor rods, the at least one arm or tab being configured, in use, to deform to engage and bear against an inner surface of a bole above horizontal as the coupling member is, in use, driven with the anchor rods into the hole.

In a preferred embodiment, the coupling member comprises a hollow or tubular portion configured for receiving and connecting with end regions of the elongate anchor rods. A body portion of the retainer device is mounted on an outer periphery of the hollow or tubular portion of the coupling member. Preferably, the hollow or tubular portion (e.g., in the form of a generally cylindrical member) includes an internally threaded passage for threaded engagement with an external thread on an outer periphery of the anchor rods. The retainer device is mounted on an outer periphery of the hollow or tubular portion, and the hollow or tubular portion has or presents an abutment, e.g., a flange, against which the body portion of the retainer device is adapted to engage or abut as the coupling member is, in use, driven with the rods into the hole.

In a preferred embodiment, the hollow or tubular portion includes the abutment, e.g., a flange, at lower end region thereof, wherein the hollow or tubular portion preferably includes a second abutment, e.g., a second flange, at an opposite upper end region thereof against which the body portion is, in use, adapted to engage or abut as the retainer device supports the elongate anchor rods within the hole.

In an alternative embodiment, the retainer device may be fixed or rigidly attached to the coupling member. For example, the body portion of the retainer device could be fixed or rigidly attached to or integral with the hollow or tubular portion of the coupling member.

According to a further aspect, the invention provides a rock anchor system, comprising: at least one elongate anchor rod; a drill bit configured for attachment to one end region of the elongate anchor rod for drilling the anchor rod into rock strata; and at least one retainer device according to any of the embodiments described above for retaining or holding the anchor rod in a hole drilled in the rock strata above horizontal.

In a preferred embodiment of the rock anchor system, the at least one elongate anchor rod comprises an external helical thread formed on the outer periphery of the anchor rod, and preferably over substantially the entire longitudinal extent of the anchor rod. In this regard, the drill bit may be configured for threaded engagement with the helical thread formed on the outer periphery of the anchor rod. To this end, the drill bit may include an internally threaded socket or recess for receiving an end of the anchor rod in screwed connection therewith.

In a preferred embodiment, the anchor rod is hollow or includes a longitudinally extending channel or conduit for introducing cement grout or resin there-through into the hole drilled in the rock strata.

In a preferred embodiment of the rock anchor system, the at least one elongate anchor rod comprises a plurality of complementary anchor rods that are configured or adapted to be securely joined or coupled together in substantially axial alignment. The at least one retainer device preferably comprises a corresponding plurality of retainer devices. Adjacent anchor rods of the plurality of complementary anchor rods are preferably configured to be joined or coupled together in substantially axial alignment by a coupling member. Each coupling member may have a shoulder that extends or projects radially from the external periphery of the anchor rod. In this way, the coupling member shoulder may form an abutment for the body portion of the retainer device against translational or sliding movement along the anchor rod.

In a preferred embodiment, therefore, the rock anchor system comprises two or more elongate complementary anchor rods configured to be securely joined or coupled together in substantial axial alignment by a coupling member provided between each pair of axially adjacent anchor rods. The drill bit is configured for attachment to a free or distal end region of a distalmost anchor rod for drilling the anchor rod assembly into rock strata, and a respective said at least one retainer device may be provided to be mounted to each complementary anchor rod above the coupling member that joins it to an adjacent anchor rod. Again, each coupling member may have a shoulder that extends or projects radially from the outer periphery of the anchor rod to form an abutment for the body portion of the retainer device against translational movement of the retainer device along the respective anchor rod.

The rock anchor system will desirably comprise a tensioning assembly located at an opposite end region of the anchor rod/anchor rod assembly to the drill bit. The tensioning assembly may include one or more plates and nuts for securing the tensioned anchor rods at the rock face.

According to a further aspect, the present invention provides a method of installing a rock anchor in rock strata, the rock anchor comprising an elongate anchor rod having a drill bit attached at one end region thereof, the method comprising steps of:

- mounting a retainer device on an outer periphery of the anchor rod, the retainer device having at least one arm or tab that projects in a direction transverse to a longitudinal extent of the first anchor rod; and
- rotating the anchor rod with the drill bit to drill the anchor rod into the rock strata to form a hole for receiving and securing the anchor rod;
- whereby, as the anchor rod advances into the hole by drilling, the retainer device mounted thereon is driven into the drilled hole, and whereby the at least one arm or tab deforms to engage and bear against an inner surface of the hole for retaining or holding the anchor rod in the hole.

In a preferred embodiment, the method comprises: providing an abutment, such as a shoulder member, for engagement with the retainer device as the anchor rod advances into the hole thereby to drive or push the retainer device into the drilled hole as the anchor rod advances into the hole during drilling. In this way, as the anchor rod advances into the hole by drilling, the retainer device mounted thereon engages an abutment on the outer periphery of the anchor rod and is driven into the drilled hole. In one example, the abutment may be provided at an opposite end region of the anchor rod, e.g., in the form of a coupling member for joining or coupling another anchor rod. In another example, the abutment may be provided at an intermediate position along a length of the anchor rod, e.g., in the form of a fitting or collar which may be fixed on an outer periphery of the anchor rod, such as by swaging, brazing or welding.

In a preferred embodiment, the method comprises: attaching a coupling member at the opposite end region of the anchor rod for securely joining or coupling a second elongate anchor rod in substantial axial alignment with the said anchor rod having the drill bit, wherein the coupling member presents the abutment for the retainer device.

In a preferred embodiment, the method further comprises steps of:

- securely and non-rotatably joining or coupling a second elongate anchor rod to a proximal end of the anchor rod driven into the drilled hole in substantial axial alignment therewith;
- mounting a second retainer device on an outer periphery of the second anchor rod, the second retainer device having at least one arm or tab that projects in a direction transverse to a longitudinal extent of the second anchor rod; and
- rotating the securely joined or coupled anchor rods to drill the anchor rods into the rock strata to extend the hole for receiving and securing the anchor rods,
- whereby, as the anchor rods advance into the hole during drilling, the second retainer device is driven into the drilled hole, whereby the at least one arm or tab of the second retainer device deforms to engage and bear against an inner surface of the hole for retaining or holding the anchor rods in the hole.

According to yet a further aspect, the present invention provides a method of installing a rock anchor in rock strata, comprising steps of:

- attaching a drill bit to one end of an elongate anchor of the rock anchor;
- mounting a retainer device on the elongate anchor rod, the retainer device having at least one arm or tab that projects in a direction transverse to a longitudinal extent of the anchor rod;
- rotating the anchor rod to drill the anchor rod into the rock strata to form a hole for receiving and securing the anchor rod; and
- driving the anchor rod and the retainer device mounted thereon into the drilled hole, whereby the retainer device is fixed or held against movement along the anchor rod as the anchor rod and retainer device are driven into the hole, and whereby the at least one arm or tab deforms to engage and bear against an inner surface of the hole for retaining or holding the anchor rod in the hole.

According to yet another aspect of the present invention, there is provided a method of installing a rock anchor in rock strata, wherein the rock anchor includes a drill bit attached to one end region of an anchor rod, an abutment member having a shoulder extending radially beyond an outer periphery of the anchor rod, and a retainer device mounted on an outer periphery of the anchor rod between the shoulder and the drill bit, the retainer device having at least one arm or tab that projects in a direction transverse to a longitudinal extent of the anchor rod, the method comprising:

- rotating the anchor rod to drill the anchor into the rock strata to form a hole for receiving and securing the anchor rod, wherein as the anchor rod advances into the hole, a portion of the retainer device abuts against the shoulder thereby pushing the retaining device into the hole.

Preferably, the method further comprises: mounting a second retainer device on an outer periphery of a second elongate anchor rod, the second retainer device having at least one arm or tab that projects in a direction transverse to a longitudinal extent of the second anchor rod; securely coupling the second anchor rod to a proximal end of the anchor rod driven into the hole via a coupling member such that the second retainer device locates between the coupling member and a second abutment member on the second anchor rod having a shoulder extending radially beyond an outer periphery of the second anchor rod; and, rotating the anchor rod to drill the anchor into the rock strata to extend the hole for receiving and securing the anchor rod, wherein as the anchor rod advances into the hole, a portion of the second retainer device abuts against the second shoulder thereby pushing the second retainer device into the hole.

The retainer device and rock anchor system according to preferred embodiments of the invention may thus enable safe and effective installation of a self-drilling anchor (SDA) in above horizontal holes and thereby provide an effective alternative to the use of cable bolts and other types of rock anchors in "up-holes". It will be noted that this may potentially provide a more efficient installation process and/or a substantial time saving, with SDAs typically able to be installed in about half the time required for traditional cable bolts. Furthermore, SDAs are well-suited to installation with a "jumbo" drill rig, which may have some operational and/or safety advantages compared to traditional cable bolting.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference signs designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will also be understood that certain actions and/or steps in an embodiment of a method may be described or depicted in a particular order of occurrences while those skilled in the art will understand that such specificity with respect to sequence is not actually required.

DETAILED DESCRIPTION OF PREFERRED EMBODIMENTS

Figure 1:
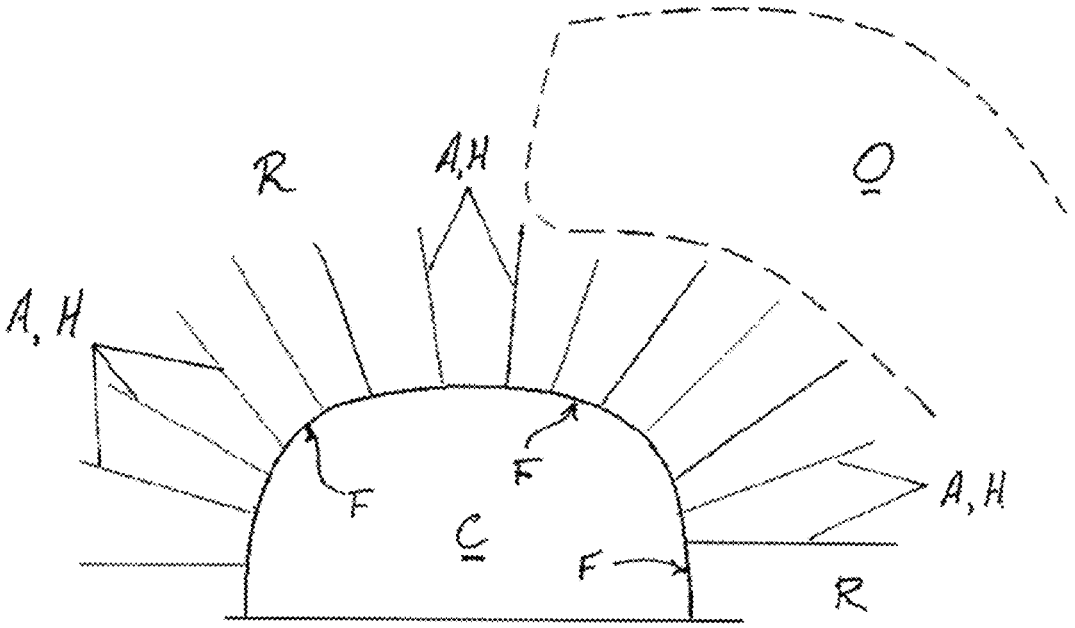
FIG. 1 is a schematic cross-sectional view of an excavated cavity in a mine environment illustrating rock anchors installed in rock strata to stabilise the rock strata.

Referring firstly to FIG. 1 of the drawings, a cross-sectional view of a mine environment is illustrated schematically. An excavated cavity or chamber C of the mine is shown in a cross-section taken normal or transverse to a length of that cavity or chamber C into the page. The cavity C is essentially surrounded by rock strata R and an ore deposit O above and displaced into the page from the cavity C can also be seen. The cavity C has been excavated to provide access for workers and equipment into the vicinity of the ore body O. Where the rock strata R surrounding the cavity C is unstable and liable to rock-fall or even partial collapse, rock anchors A can be employed to stabilise the rock strata R to render the underground environment safe for personnel and equipment. To this end, the rock anchors A are set in holes H that are drilled from the cavity C from an outer rock face F into the rock strata R. The holes H drilled and the rock anchors themselves are typically in the range of about 5 to 15 metres long.

Figure 2:
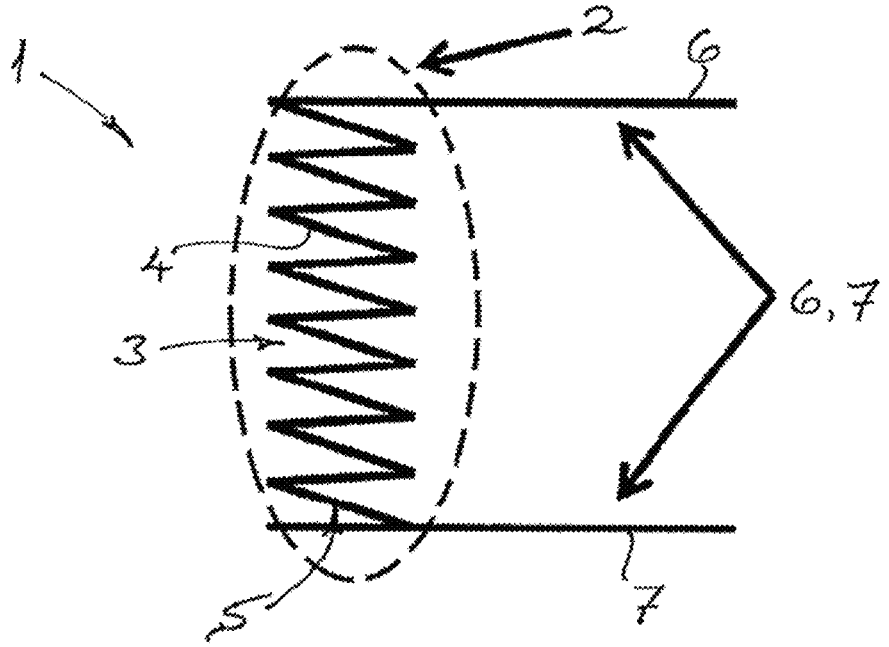
FIG. 2 is a schematic side view of a retainer device for retaining or holding an anchor rod of a rock anchor according to a preferred embodiment of the invention.
Figure 3:
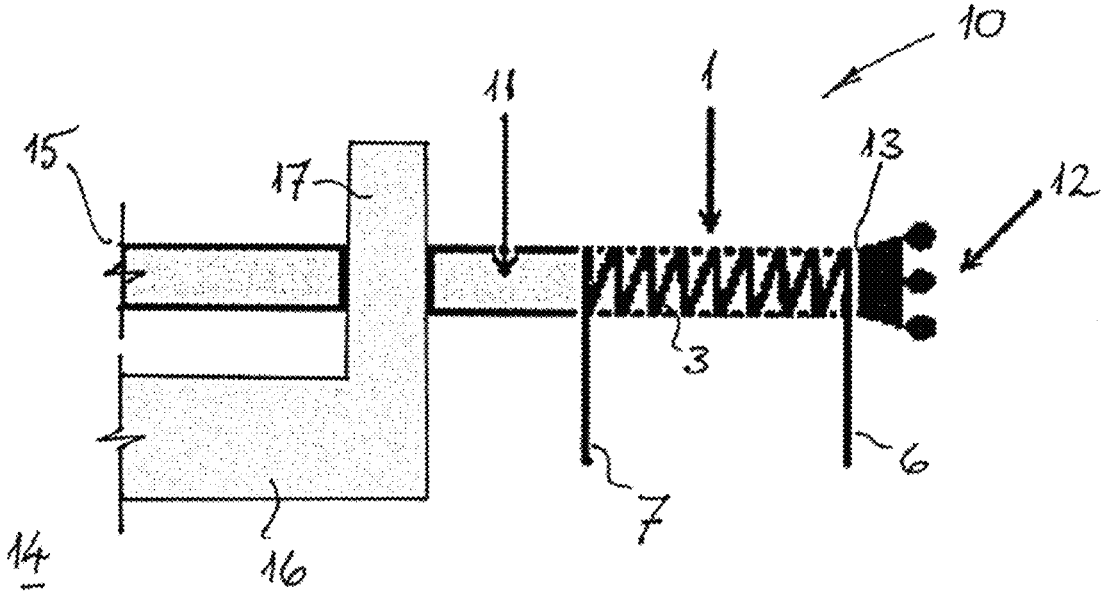
FIG. 3 is a schematic side view of a rock anchor system according to a preferred embodiment of the invention, including a retainer device as shown in FIG. 2.

With reference now to FIGS. 2 and 3 of the drawings a retainer device 1 and a rock anchor system 10 including the retainer device 1 according to a preferred embodiment are shown schematically. The retainer device 1 comprises a body portion 2 (shown encircled by a broken line in FIG. 2) that is configured to be mounted on an outer or external periphery of an anchor rod 11 of the rock anchor system 10, as seen in FIG. 3. To this end, the body portion 2 comprises a helical coil 3 formed of steel wire 4 having a diameter of about 5 to 8 mm. In this way, the body portion 2 defines a channel 5 within the helical coil for receiving the anchor rod 11. An inner periphery of the channel 5 presents a profile that may be configured to engage with an external helical thread (not shown) formed on the outer periphery of the anchor rod 11. That is, the helical coil 3 may have an inner diameter and coil pitch that complement or match the helical thread formed on the external periphery of the anchor rod, such that the coil is configured to receive and engage with the helical thread of the anchor rod 11 such that the body portion 2 of the retainer device 1 may be screwed onto the anchor rod.

Referring still to FIGS. 2 and 3, the retainer device 1 further comprises two locking arms or tabs 6, 7 that project outwardly from the body portion 2 or coil 3 in a direction transverse to a central axis of the channel 5 for receiving the anchor rod 11. Thus, the two arms or tabs 6, 7 are configured to project transverse to a longitudinal extent of the anchor rod 11. In particular, the two locking arms or tabs 6, 7 comprise a first arm or tab 6 that projects or extends from one end region of the body portion coil 3, and a second arm or tab 7 that projects or extends from an opposite end region of the body portion coil 3. Each of the arms or tabs 6, 7 is formed from the same wire as the helical coil 3, and is effectively a tail or end length of that steel wire.

As noted above, when used in the rock anchor system 10, the retainer device 1 can be placed or screwed onto the outer periphery of the anchor rod 11, as seen in FIG. 3, via the channel 5 formed by the helical coil 3 of the body portion 2. A drill bit 12, and especially a sacrificial drill bit, is typically then secured at a distal end 13 of the elongate anchor rod 11 adjacent the retainer device 1, as shown in FIG. 3. During use, the rock anchor system 10 including the retainer device 1 may be installed using a hydraulic drilling rig 14 known as a "jumbo" rig. A proximal end 15 of the elongate anchor rod 11 is operatively coupled to the drilling rig 14 so that the drilling rig 14 can impart both rotary and percussive motion to the anchor rod 11 and thus also to the drill bit 12. The elongate anchor rod 11 with the drill bit 12 securely attached at the end thereof is supported in the drill rig 14 by a boom 16 which includes a centraliser 17 for maintaining a desired position of the anchor rod 11 during drilling.

Figure 4:
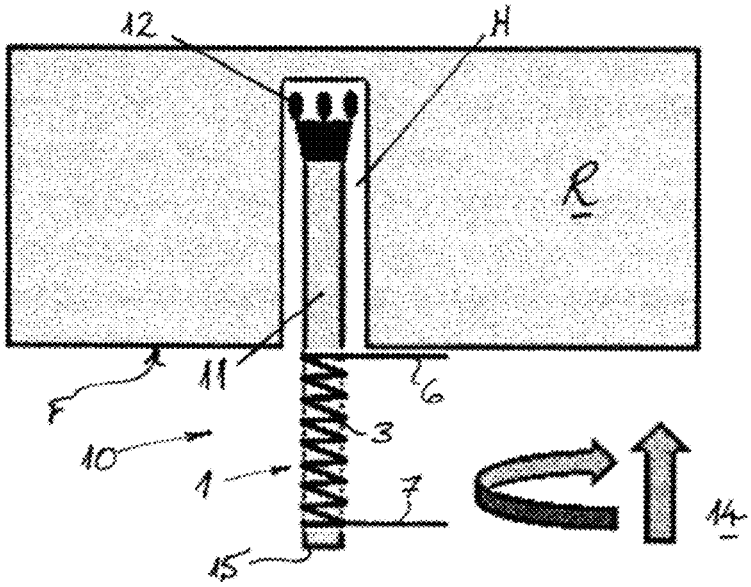
FIG. 4 is a schematic side view of a rock anchor system as shown in FIG. 3 during one stage of its installation.
Figure 5:
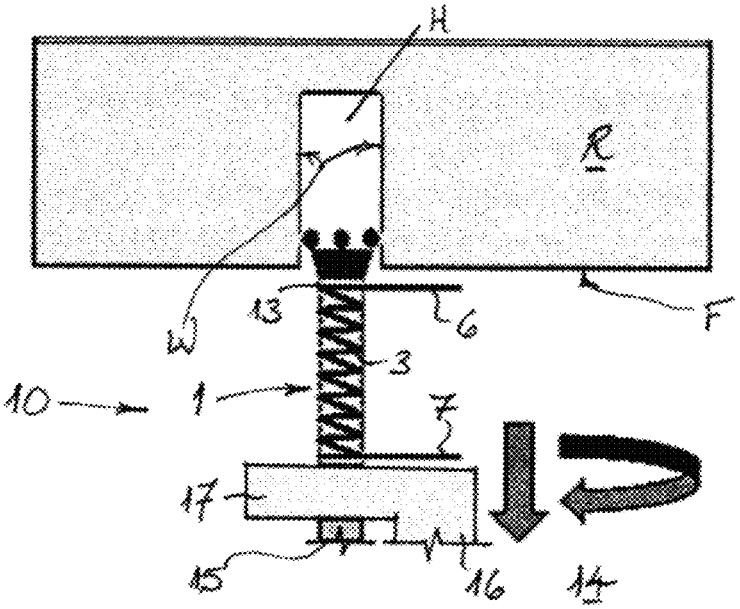
FIG. 5 is a schematic side view of the rock anchor system shown in FIG. 3 during another stage of its installation.
Figure 6:
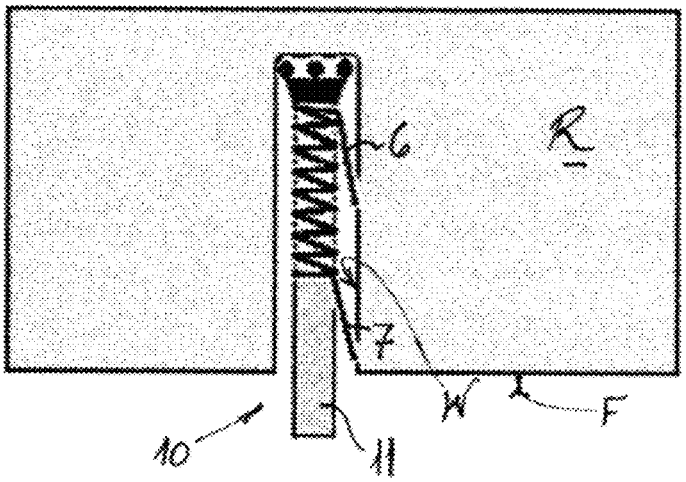
FIG. 6 is a schematic side view of the rock anchor system shown in FIG. 3 during a further stage of its installation.

With reference now to FIGS. 4 to 6 of the drawings, the operation and use of the retainer device 1 and the rock anchor system 10 of this embodiment will be explained. In use, the drill bit 12 on the end of the anchor rod 11 supported in the drill rig 14 is brought to the rock face F and the drill rig 14 is operated to rotate and advance the anchor rod 11 and drill bit 12. In doing so, the drill bit 12 drills a bore or hole H into the rock R and the retainer device 1 is able to move relative to the anchor rod 11 along the axial extent of the anchor rod 11 away from the drill bit 12, as shown in FIG. 4. In particular, when the first arm or tab 6 engages the rock face F, the rotation of the anchor rod 11 by the drill rig 14 occurs relative to the retainer device 1, which is not fixed to the anchor rod, but rather freely movable in its threaded engagement. Thus, frictional interference at the rock face F causes the anchor rod 11 to rotate relative to the retainer device 1 and the retainer device 1 is able to migrate (relatively) along the longitudinal extent of the anchor rod 11 due to the interaction between the helical screw thread on the outer periphery of the anchor rod 11 and the internal profile of the channel 5 formed by the coil 3 of body portion 2.

Once the hole H has been drilled to a sufficient depth for a single anchor rod 11—i.e. with just sufficient length of the rod 11 protruding from the hole H at the rock face F to perform tensioning and securing—the rotation and percussive advancement of the drill bit 12 is halted and the drill rig 14 is operated to rotate the anchor rod 11 and drill bit in the opposite direction as the anchor rod 11 is retracted or withdrawn from the hole H. This causes the retainer device 1 (i.e. via the coil 3 of the body portion 2) to migrate relative to the anchor rod 11 back to a position close to the end 13 adjacent the drill bit 12, as can be seen in FIG. 5. Like the rock face during the drilling step, the centraliser 17 located on the boom 16 of the drill rig 14 also acts as a stop for the retainer device 1 as it moves relatively along the length of the anchor rod 11.

As can be seen with reference to FIG. 6, the anchor rod 11, with the drill bit 12 and retainer device 1 mounted thereon, is then driven into the drilled hole H via the drill rig 14 with an essentially linear or axial movement or thrust. The retainer device 1 is essentially fixed or held against translational movement along the length of the anchor rod 11 when the anchor rod 11 and retainer device 1 are driven into the hole H. In this embodiment, this is due to the interaction and interference between the helical screw thread on the outer periphery of the anchor rod 11 and the internal profile of the channel 5 formed by the coil 3 of body portion 2. As a result, the arms or tabs 6, 7 deform both resiliently and plastically to engage and bear against an inner wall W of the hole H for retaining or holding the anchor rod 11 in the hole H, as seen in FIG. 6. Indeed, this interaction between the locking arms or tabs 6, 7 and the side walls W of the hole H is easily sufficient to prevent the anchor rod 11 from falling out of the vertical hole H under self-weight. The locking arms or tabs 6, 7 may be readily designed to resist a pull-out force up to an order of magnitude greater than the forces it can be expected to need to withstand in use.

In this way, the retainer device 1 acts to retain or hold the anchor rod 11 of the rock anchor system 10, especially a self-drilling anchor, in the vertically drilled "up-hole". This allows an operator to disconnect the proximal end 15 of the anchor rod 11 from the drill rig 14 and to couple or connect the distal end 13 of a second anchor rod 11' to the proximal end 15 of the anchor rod 11 driven into the hole H. The anchor rods 11, 11' are of basically the same dimensions and are securely and rigidly coupled or connected in substantial axial alignment. Before securely coupling the two anchor rods 11, 11' together, a second retainer device 1' is mounted on an outer periphery of the second anchor rod 11' in the same way as before. After coupling, the drilling may then continue by rotating the securely coupled anchor rods 11, 11' to drill the anchor rods further into the rock strata R to extend the hole H for receiving and securing the anchor rods. The second retainer device 1' is movable relative to the second anchor rod 11' outside of the hole H and may migrate along the length of the second anchor rod 11' under rotation, as before. When the hole H is sufficiently deep for the two anchor rods 11, 11', the rotation and percussive advancement of the drill bit 12 is again halted and the drill rig 14 is operated to rotate the anchor rods 11, 11' and drill bit 12 in the reverse direction as the anchor rods 11, 11' are retracted or withdrawn from the hole H. This causes the second retainer device 1' (i.e. again via the coil of the body portion) to migrate relative to the anchor rod 11' back to a position close to the distal end 13.

Figure 7:
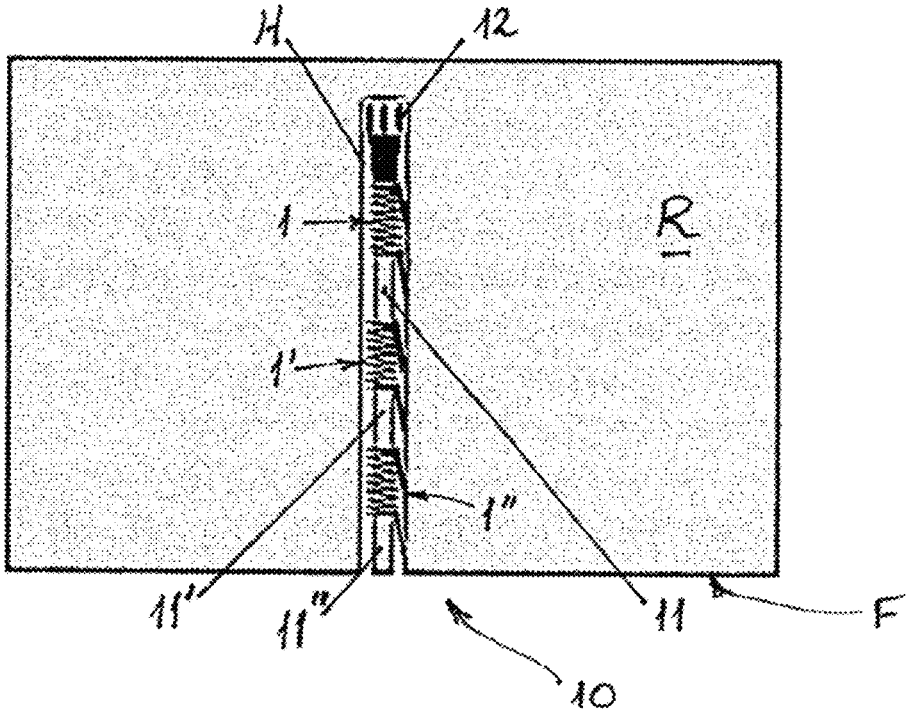
FIG. 7 is a schematic side view of a rock anchor system according to another preferred embodiment of the invention during installation.

It will be noted that the first retainer device 1 already within the hole H may remain more-or-less stationary bearing against the wall W of the hole H as the hole is drilled deeper. This is because, as the coupled anchor rods 11, 11' are rotated and advanced during drilling, the first retainer device 1 may again migrate (relatively) along the length of the first anchor rod 11. It will be appreciated that the retainer device 1 already deployed in the hole H would, to some extent, act to resist the retraction of the coupled anchor rods 11, 11' and could be damaged during that retraction. This is inconsequential, however, firstly because the retraction force that can be applied by the drill rig 14 is far in excess of the resistance force offered by the first retainer device 1, and secondly because the first retainer device 1 has already performed its function of retaining and supporting the first anchor rod 11 in the hole H during the coupling or connection of the second anchor rod 11'. Now the second retainer device 1' will retain and hold both of the anchor rods 11, 11' in the hole H during connection of a third anchor rod 11", as seen in FIG. 7.

In this regard, when the coupled anchor rods 11, 11' are driven back into the hole H via a linear thrust imparted by the drill rig 14, the second retainer device 1' is essentially fixed or held against axial movement along the second anchor rod 11' by the interaction of the coil body portion and external thread, as before. Thus, the first and second locking arms or tabs of the second retainer device 1' deform as shown in FIG. 6 to engage and bear against the wall W of the hole H to retain or hold the coupled anchor rods 11, 11' in the hole H under their self-weight, while a third anchor rod 11" may be connected.

Each of the anchor rods 11, 11', 11" is typically of about 2.5 metres or 3 metres in length and is hollow or includes a longitudinal channel or conduit for injecting cement grout or resin. Thus, once the hole H is sufficiently deep and sufficient lengths of anchor rods 11, 11', 11" have been inserted, the cement grout or resin is injected through the hollow anchor rods into the hole H to fix the anchor rod in the hole. After the resin or grout has been allowed to cure; the coupled anchor rods 11, 11', 11" may optionally be tensioned at the free or proximal end region 15 of the last anchor rod 11" outside the hole H adjacent the rock face F. A plate and nut fixture (not shown) may then be installed on the exposed end of the tensioned anchor rods at the rock face F.

Figure 8:
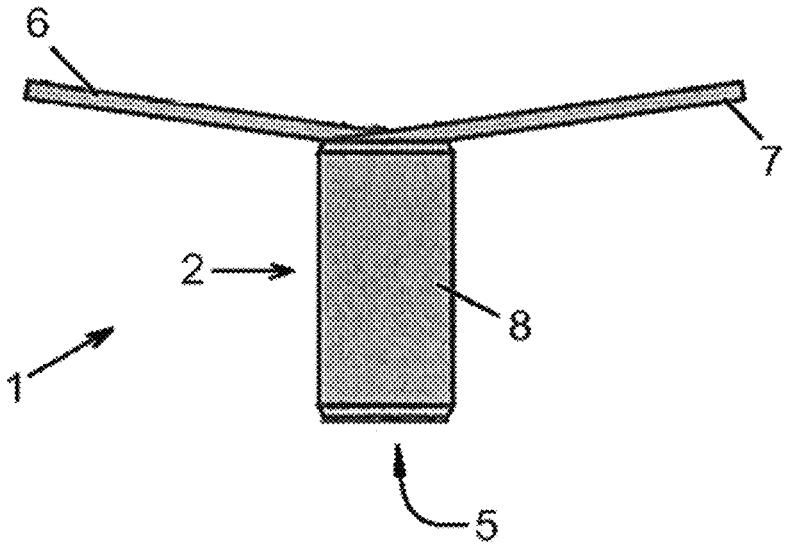
FIG. 8 is a schematic side view of a retainer device according to a further preferred embodiment of the invention.

Referring now to FIG. 8 of the drawings, an alternative embodiment of a retainer device 1 is shown schematically. The retainer device 1 of this embodiment comprises a body portion 2 in the form of a generally cylindrical sleeve 8 configured to be mounted on an outer or external periphery of an anchor rod 11. In this embodiment, the retainer device 1 again comprises two locking arms or tabs 6, 7 that project outwardly from the body portion 2 like prongs, but this time from the same end region of the body portion 2. As was the case for the above described embodiments, the retainer device 1 of this alternative embodiment is preferably fabricated from a robust metal, such a steel, and the arms or tabs 6, 7 are preferably formed integrally with the body portion 2. That is, the arms or tabs 6, 7 may comprise strip-like elements of steel and may be integral with the cylindrical sleeve 8 of the body portion 2. Although the body portion 2 in this embodiment is in the form of a sleeve 8, it could also be formed as a helical coil similar to the embodiments described above without altering its mode of operation. In that case, for example, two lengths of wire could be coiled together (e.g. in a double helix) to form the body portion, with an end portion of one length forming a first locking arm 6, and an end portion of the second length forming the second locking arm 7 at the same end of the body portion 2.

In this alternative embodiment of the retainer device 1 shown in FIG. 8, instead of the body portion 2 having a profile configured to engage and interact with the external helical thread of the anchor rod 11, the sleeve-like body portion 2 defines a generally cylindrical channel 5 presenting a smooth profile configured to fit over the thread of the anchor rod 11. In particular, the inner periphery or diameter of the channel 5 may be sized to fit over the crests of the helical threads either in a light interference fit or in a clearance fit (i.e. with clearance or 'play'). In the case of a light interference fit, the body portion 2 of the retainer device will be lightly held by the outer periphery of the anchor rod 11 but may move or slide in axial translation in relation to the anchor rod 11 upon the application of sufficient force. In the case of a clearance fit, the inner profile of the channel 5 will be sized to fit over the outer periphery of the anchor rod 11 with room (e.g. a uniform clearance around the anchor rod in the range of 1 mm to 5 mm, and preferably 2 mm or 3 mm) for easy sliding translational movement relative to the anchor rod 11. It will be noted that the retainer device 1 of this embodiment need not be used with a threaded anchor rod 11, as the profile of the channel 5 formed by the body portion sleeve 8 is in any case not designed or intended for engagement with any thread. Instead, the retainer device 1 of this embodiment is configured for sliding movement relative to the anchor rod. As already noted above, however, provided the channel 5 it forms is appropriately sized, a helical coil 3 (or double helix), e.g., formed from wire (as in FIG. 2), may also provide sliding translational movement relative to the anchor rod.

Figure 9A:
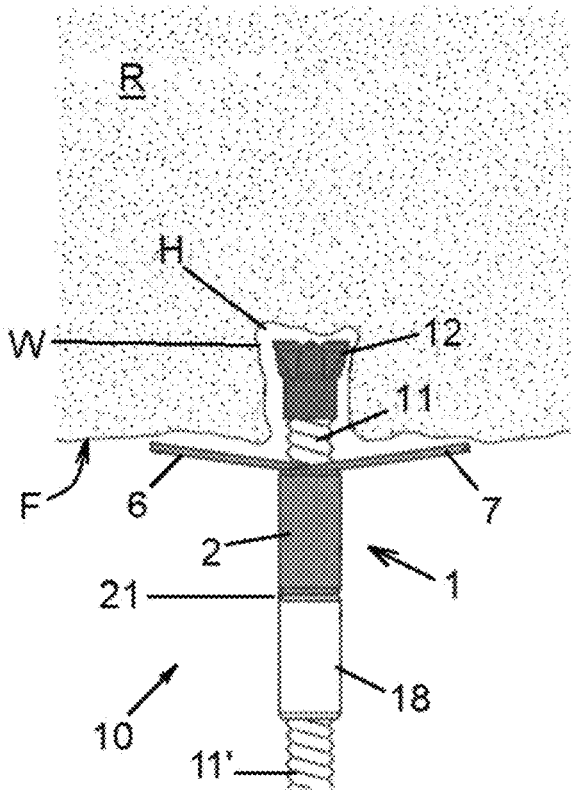
FIG. 9*a* is a schematic side view of a rock anchor system according to another preferred embodiment of the invention, having a retainer device as shown in FIG. 8, prior to advancement of the retainer device into the hole.
Figure 9B:
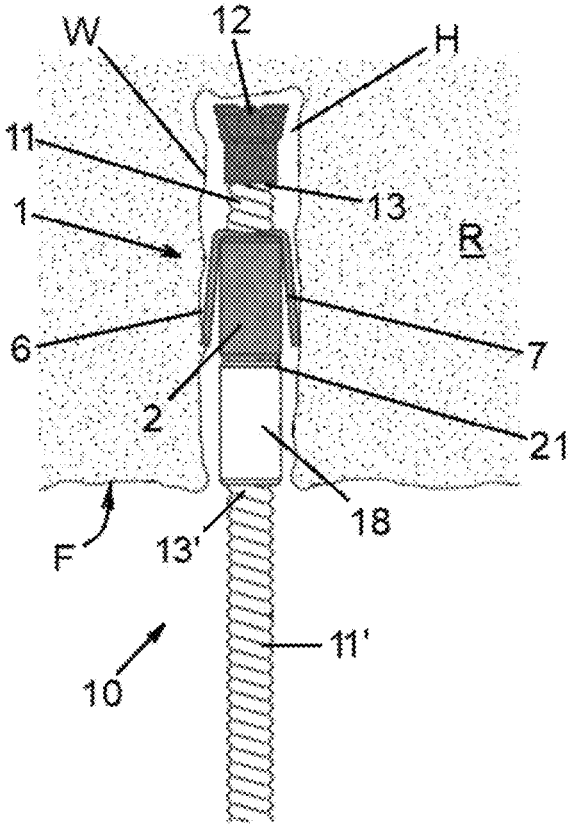
FIG. 9*b* is a schematic side view of the rock anchor system shown in FIG. 9*a* after advancement of the retainer device into the hole.

With reference now to FIG. 9*a* and FIG. 9*b* of the drawings, an embodiment of a rock anchor system 10 incorporating the retainer device 1 of FIG. 8 is shown, in which channel 5 through the body portion 2 has a profile that preferably provides a slight clearance fit (i.e. a little 'play') with the outer or external periphery of the anchor rod 11. The rock anchor system 10 also includes a drill bit 12 attached at a distal end 13 of the anchor rod 11, and a coupling member 18 attached to a proximal end 15 of the anchor rod opposite the end to which the drill bit 12 is attached. The coupling member 18 has an internal thread that matches the outer thread of the anchor rod 11 and is designed for securely joining or coupling a further anchor rod 11' to extend the length of the rock anchor system 10. That is, the coupling member 18 has a generally tubular form with a threaded interior passage 19 for interconnecting a proximal end 15 of the first anchor rod 11 with a distal end of a second anchor rod 11' in substantial axial alignment. The outer periphery 20 of the coupling member 18 is naturally therefore of greater diameter than the anchor rods 11, 11' and so projects radially outwards of the anchor rods 11, 11' that it inter-connects. In this way, coupling member 18 presents a shoulder 21 that extends radially beyond the outer periphery of the anchor rod 11 and at least part of the shoulder 21 forms an abutment for the body portion 2 (i.e. sleeve 8 or coil 3) of the retainer device 1. That is, the shoulder 21 presents an abutment surface facing toward the distal and 13 of the drill rod 11 for contact with a facing end of the body portion 2, as the retainer device 1 is mounted on the anchor rod 11 between the coupling member 18 and the drill bit 12.

Referring further to FIGS. 9*a* and 9*b* of the drawings, the operation and use of the retainer device 1 in the rock anchor system 10 of this embodiment will be explained. In using the rock anchor system 10 to install a rock anchor, the drill bit 12 on the distal end of the anchor rod 11 is brought into contact with the rock face F by a drill rig (not shown, but typically a hydraulic and percussive drilling rig—i.e. a "jumbo" rig—mentioned earlier) and the drill rig is then operated to rotate and advance the anchor rod 11 and drill bit 12. In doing so, the drill bit 12 drills a bore or hole H into the rock R. As the anchor rod 11 rotates and advances into the hole H during drilling, the anchor rod 11 is able to rotate relative to the retainer device 1 due to the 'play' of the clearance fit with the body portion 2. But when sliding translational movement of the retainer device 1 relative to the anchor rod brings the retainer device 1 into abutment with the shoulder 21 of the coupling member 18, the retainer device 1 will also be advanced along with the advancement of the anchor rod 11. When the retainer device 1 then comes into contact with the rock face F (as seen in FIG. 9*a*), there will typically be only little incidental co-rotation of the retainer device 1 with the anchor rod 11 due to frictional interaction with the rock face F. That is, rotating anchor rod 11 may move through the channel 5 in a sliding manner, such that the retainer device 1 migrates (relatively) along the anchor rod 11 without necessarily co-rotating. But, as the anchor rod 11 continues its advance into the hole H being drilled (i.e. moving from the position of FIG. 9*a* to the position in FIG. 9*b*), the shoulder 21 abutting the end of the cylindrical body portion 2 will continue to push or drive the retainer device 1 forward into the hole, as shown in FIG. 9*b*. In doing so, the retainer device 1 is held against further translational movement along the length of the anchor rod 11 by abutment with the coupling member 18. The ensuing advance of retainer device 1 into the hole H causes the two arm or tabs 6, 7 to deform, so as to engage and bear against an inner wall W of the hole H (as described previously) for holding the anchor rod 11 in the hole H. Specifically, when a full length of the drill rod 11 is driven into the hole H, the retainer device 1, and more particularly the locking arms or tabs 6, 7, interact with side walls W of the hole H to prevent the anchor rod 11 from falling out of the vertical hole H under self-weight. This enables the operator of the drill rig to stop drilling, to disconnect the drill rig from the anchor rod 11, and to attach a further anchor rod 11', 11" in axial alignment via a coupling member 18 without the anchor system 10 being able to drop out of the hole H. When the anchor rod 11 is disconnected from the drill rig or cabolter to connect a further anchor rod 11', 11" via a coupling member 18, the anchor rod 11 will be held or retained in the hole H by the retainer device 1 engaging the side walls W of the hole H. In this regard, when disconnected from the drill rig, the anchor rod 11 may drop down a little relative to the retainer device 1 (fixed in the hole H) under its self-weight until the drill bit 12 engages or abuts the top part of the body portion 2. At this point, however, the retainer device 1 will simply hold the anchor rod 11 suspended in the up-hole H. The drill rig can then be re-connected and drilling re-commenced to drill the hole H deeper into the rock R.

In the event that the channel 5 through the body portion 2 of the retainer device 1 does not receive the anchor rod 11 in a clearance fit, but rather in a light interference fit, then the retainer device 1 will tend to rotate with, and be advanced with, the anchor rod 11 as soon as the drilling commences. This will continue until the arms or tabs 6, 7 of the retainer device 1 come into contact with the rock face F, where the fictional resistance will then typically far exceed the light interference fit. That is, the retainer device 1 will remain at the rock face F and the anchor rod 11 will be advanced or pushed through the channel 5 in a sliding manner by the drill rig (i.e. the drill rig will quite easily overcome the resistance offered by the light interference fit as the retainer device 1 is held substantially stationary due to friction with the rock face F—as seen in FIG. 9*a*) until the shoulder 21 of the coupling member 19 comes into abutment with the end of the body portion 2. Thereafter, the retainer device 1 will then also be driven forward into the hole H by the coupling member 18 as the anchor rod 11 advances; with the arms or tabs 6, 7 again deforming as described previously; i.e. as seen in FIG. 9*b*. When the retainer device 1 is pushed into the hole H by the abutment with the coupling member 18, the frictional interference between the arms 6, 7 of the retainer device 1 and the side wall W of the hole H may act to prevent the retainer device 1 from rotating with the anchor rod 11 in the hole H. It is envisaged, however, that the interference fit between the anchor rod 11 and retainer device 1 could possibly lead to some degree of co-rotation of the retainer device 1 in the hole H—i.e. overcoming the resistance of the adjacent rock strata R to cause some co-rotation.

The embodiments described with reference to FIGS. 8, 9*a* & 9*b* have the advantage that no reversal of the drilling rotation and no retraction of the anchor rods 11, 11' is required before the or each retainer device 1 is driven into the hole H. Rather, each retainer device 1 is simply driven into the hole by the advancement of the drill bit 12 and the anchor rod 11 during the drilling procedure. The setting and curing of the rock anchor system 10 for these embodiments then occurs as described with reference to the embodiments of FIGS. 4 to 7. That is, once the hole H is sufficiently deep and sufficient lengths of anchor rods 11, 11', 11" have been inserted, a cement grout or resin is injected through the hollow anchor rods into the hole H to fix the anchor rod in the hole. After the resin or grout has been allowed to cure; the coupled anchor rods 11, 11', 11" may optionally be tensioned at the free or proximal end region 15 of the last anchor rod 11" outside the hole H adjacent the rock face F. A plate and nut fixture may then be installed on the exposed end of the tensioned anchor rods at the rock face F. In this regard, reference is now made to drawing FIG. 11.

Figure 11:
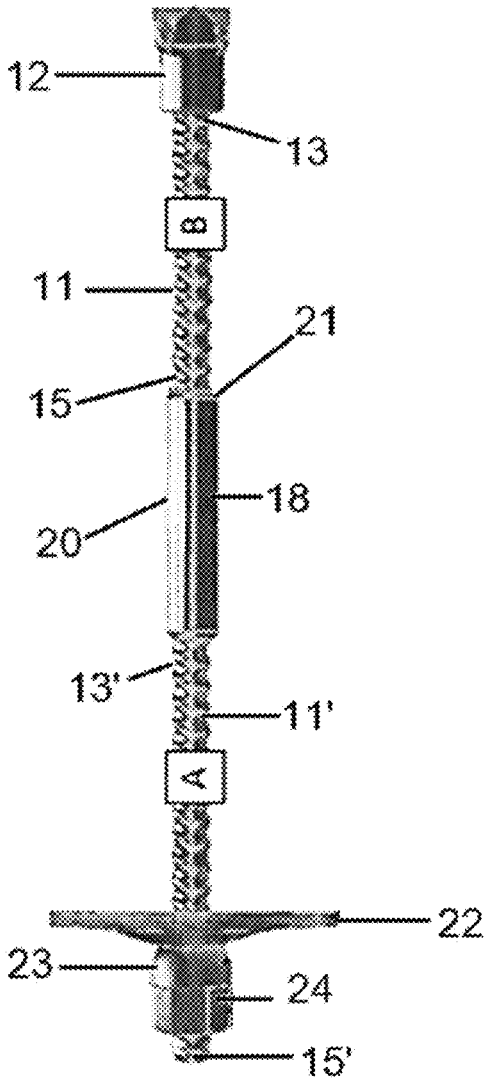
FIG. 11 is a schematic side view of an embodiment of a rock anchor system without a retainer device according to an embodiment of the invention mounted thereto.

Drawing FIG. 11 shows an example of parts of a rock anchor system 10 employing a retainer device 1 of any one of the embodiments. The parts of the rock anchor system 10 shown in FIG. 11 include two elongate anchor rods 11,11' securely coupled or joined by a threaded tube-like coupling member 18, with the two anchor rods 11,11' in substantial axial alignment. The distal end of the first anchor rod 11 is provided with a drill bit 12 and the opposite (proximal) end of the rock anchor system 10 has a tensioning mechanism, comprising a bearing plate 22, dome washer 23 and threaded nut 24. In this rock anchor system 10 in FIG. 11, a retainer device 1 will be mounted on the first anchor rod 11 denoted "B", on an end of which the drill bit 12 is attached. As described above, the inner periphery of the channel 5 through the body portion 2 of the retainer device 1 preferably has a clearance fit (or a light interference fit) with the outer periphery of the anchor rod 11, so that the retainer device 1 is slidable along the anchor rod 11 (if necessary, upon application of a low force). The body portion 2 of the retainer device 1 is configured to engage or abut with the coupling member 18 to prevent its movement along the anchor rod 11. The second anchor rod 11' in the rock anchor system 10 is denoted "A" in FIG. 11. Typically, the length of the second anchor rod 11' would be substantially longer than the first anchor rod 11, which is used to locate the retainer device 1 in abutment with the coupling member 18 when the rod is installed in the hole H. For example, in a preferred embodiment, the length of anchor rod "A" may be about 2.5 m and the length of "B" may be about 0.5 m (providing for a ratio of A:B of 5:1), although other arrangements are possible.

Once this rock anchor system is installed in the hole H, the retainer device will act to prevent the rock anchor system falling out under self-weight, such that the drill rig can move onto installing another rock anchor elsewhere, and the rock anchor system can subsequently be grouted or resin-cured in place within the hole. Once the grout or resin has cured, another rig can be brought into place to tension the rock anchor system 10 via the tensioning assembly comprising bearing plate 22, dome washer 23 and nut 24. It is envisaged that a rock anchor system 10 similar to that of FIG. 11 may be used, but with further lengths of anchor rods beyond two. Each such anchor rod would be joined by a coupling member 18, and a further retainer device 1 may be located between consecutive coupling members 18. Due to space limitations in mining operations it is further envisaged that a rock anchor system having multiple lengths of anchor rods can be assembled sequentially as the rock anchor is drilled into the strata, with the rock anchor system being held in place within the hole by the retainer device 1 whilst an additional anchor rod is coupled to the rock anchor system via a coupling member. Further retainer devices 1 may be mounted to the further anchor rods added to system, the said further retainer devices 1 being pushed into the hole H by the further coupling members 18 added to the rock anchor system 10.

Figure 12:
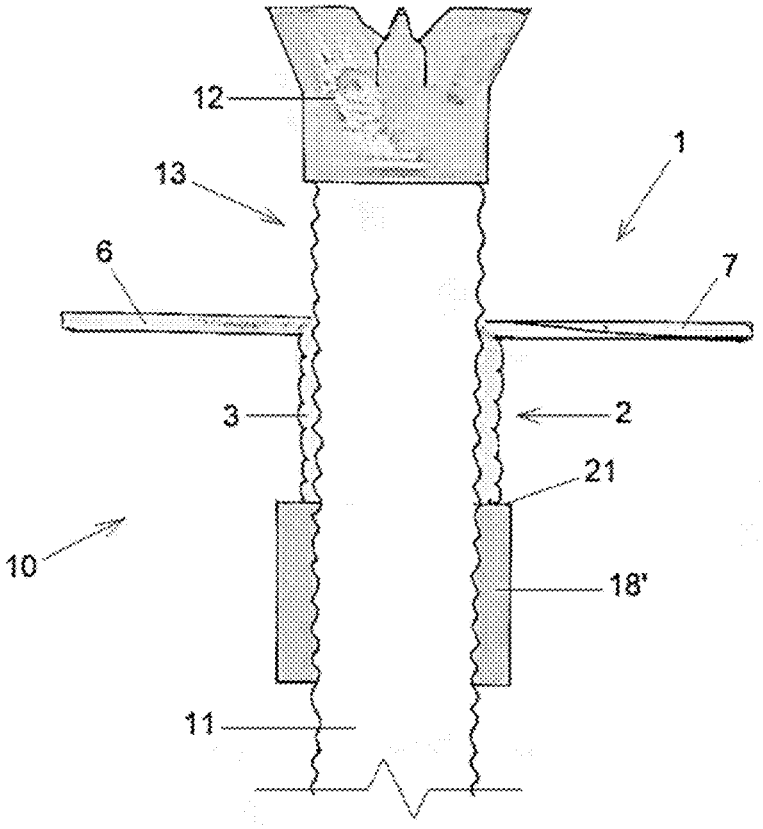
FIG. 12 is a schematic side view of a rock anchor system according to a further preferred embodiment of the invention having a retainer device analogous to the embodiment in FIG. 8.

With reference now to FIG. 12 of the drawings, a variation of the rock anchor system 10 shown in FIGS. 9*a* and 9*b* is illustrated. In this embodiment, the retainer device 1 is formed from steel wire (i.e., like the embodiment of FIG. 2) with the body portion 2 wound in a helical coil 3, or more precisely two helical coils 3 as a double helix, defining a central channel 5 for receiving anchor rod 11 in either a clearance fit or light interference fit to allow translational or axial sliding movement along the anchor rod 11. An end portion or 'tail' of the length of wire forming one helical coil 3 forms the first elongate locking arm or tab 6 and an end portion or 'tail' of the length of wire forming the other helical coil 3 forms the second locking arm or tab 7 at the same end of the body portion 2. These first and second locking arms 6, 7 thus take the form of prongs that project outwards from the body portion 2 generally perpendicular to the longitudinal axis of the anchor rod 11. In this embodiment, an abutment for the body portion 2 of retainer device 1 on the outer periphery of the anchor rod 11 is provided by an abutment member 18', e.g., here in the form of a collar or sleeve, that is fixed or secured to the anchor member 11 by swaging, crimping, welding, brazing or by any other suitable fixing means. In this way, the collar-type abutment member 18' can be fixed or secured at any suitable position along the length of the anchor rod 11, rather than only at an end of the anchor rod 11 as is possible with the coupling member 18 in FIGS. 9*a* and 9*b*. As was the case with the coupling member 18 in the embodiment of FIGS. 9*a* and 9*b*, the abutment member 18' in FIG. 12 presents a shoulder 21 against which the body portion 2 of the retainer device 1 may engage to prevent translational or sliding movement longitudinally along the anchor rod 11. The two helical coils 3 of the body portion 2 are closely wound to form a generally cylindrical body, a base of which is configured to engage and bear against the shoulder 21 of the collar 18'.

Figure 13:
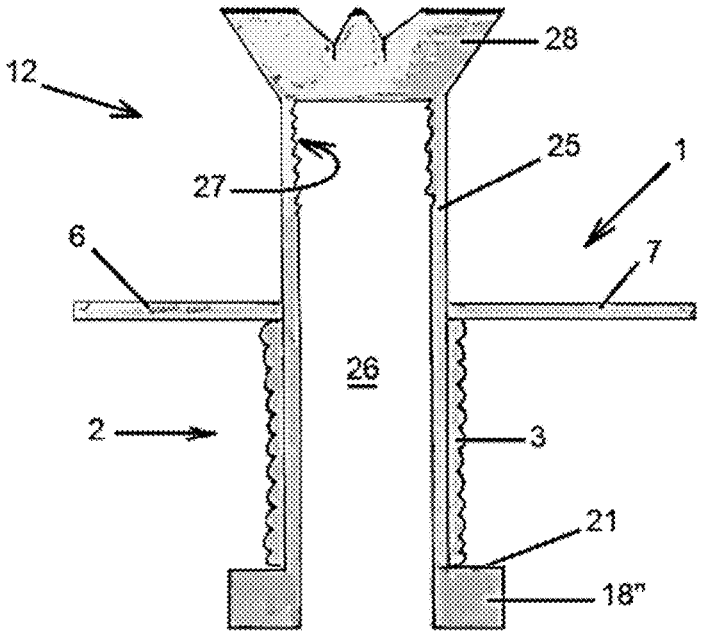
FIG. 13 is a schematic side view of a drill bit assembly according to an embodiment of the invention including a retainer device analogous to the embodiment in FIG. 8.
Figure 14:
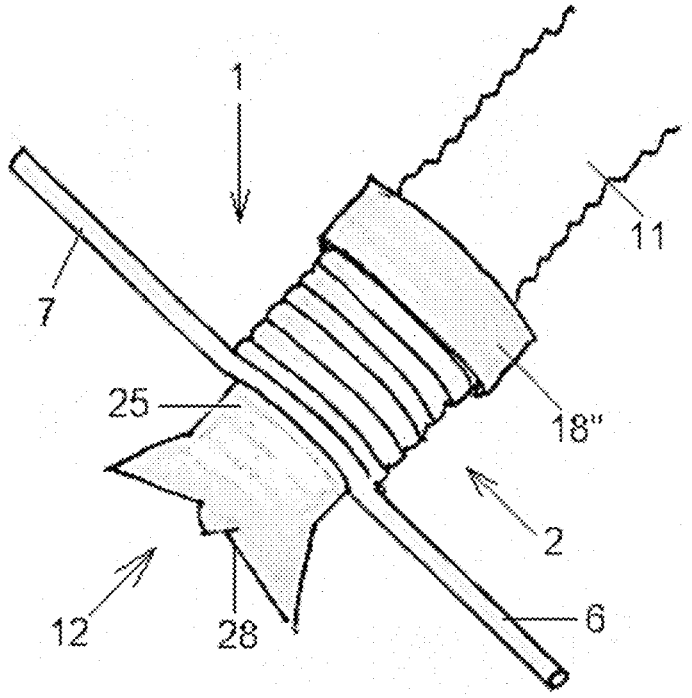
FIG. 14 is a schematic perspective view of a rock anchor system according to a preferred embodiment of the invention incorporating the drill bit assembly of FIG. 13.

Referring to drawing FIGS. 13 and 14, a drill bit 12 is shown that incorporates a retainer device 1 according to an embodiment of the invention. The drill bit 12 in this embodiment has a generally cylindrical sleeve member 25 forming a socket portion defining a cavity 26 configured for receiving and connecting with a distal end of the elongate anchor rod 11. For this purpose, the sleeve member 25 includes an internal screw thread 27 over at least part (optionally all) of its length within the cavity 26 for threaded engagement with an external screw thread provided on the outer periphery of the anchor rod 11. The distal-most tip of the drill bit 12 on the distal end of sleeve member 25 presents a drill bit head 28 with cutting teeth for cutting through the rock strata R. The retainer device 1 in this embodiment is substantially as shown and described with reference to FIG. 12. The helically coiled body portion 2 of the retainer device 1 is mounted on an outer periphery of the cylindrical sleeve member 25 and the sleeve member 25 includes an abutment member in the form of a flange 18" at its proximal end that presents an abutment or shoulder 21 which the body portion 2 of the retainer device 1 is configured to engage or abut against. This abutment member or flange 18" could potentially be removable from the sleeve member 25 (e.g., via a screw thread—not shown) to enable the coiled body portion 2 of the retainer device 1 to be placed over the cylindrical sleeve member 25—i.e., to enable the sleeve member 25 to be inserted into the channel 5 of the body portion 2 of the retainer device 1. After drilling the drill bit 12 and anchor rod 11 into a up-hole H, if the anchor rod 11 is disconnected from the drill rig or 'cabolter' to connect another length of anchor rod 11', e.g., via a coupling member 18, the anchor rod 11 will be held or retained in the hole H by the arms or tabs 6, 7 of the retainer device 1 engaging the side walls W of the hole H. In this regard, when disconnected, the anchor rod 11 may slide down a little relative to the retainer device 1 (fixed in the hole H) under its self-weight until the drill bit head 28 engages or abuts an upper part of body portion 2. At this point, however, the retainer device 1 will simply hold the anchor rod 11 suspended in the up-hole H.

Figure 15:
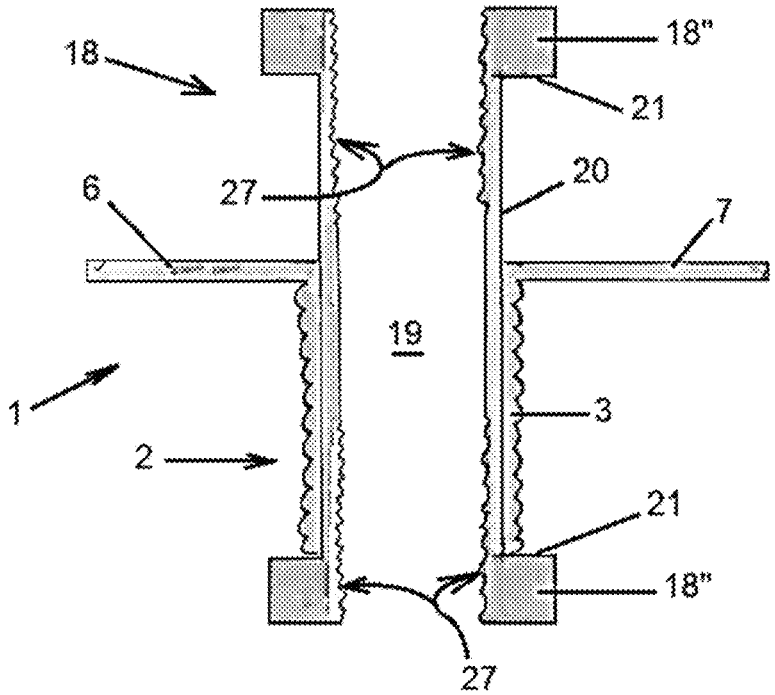
FIG. 15 is a schematic side view of a coupling member according to an embodiment of the invention including a retainer device analogous to the embodiment in FIG. 8.

With reference to FIG. 15 of the drawings, a coupling member 18 or a coupling member assembly for use with the rock anchor system 10 shown in FIGS. 9*a* and 9*b* is illustrated. In this embodiment, the coupling member 18 has a generally tubular form with a generally cylindrical member comprising a passage or cavity 19 with an internal screw thread 27 for interconnecting the ends of two elongate anchor rods 11, 11' in the rock anchor system 10 in substantial axial or longitudinal alignment. The coupling member 18 comprises a retainer device 1 having a body portion 2 mounted on an outer periphery 20 of the tubular coupling member 18 and one or more (in this case, two) arms or tabs 6, 7 that projects outwards from the body portion 2 in a direction transverse to a longitudinal extent of the anchor rods 11, 11'. As already explained above, the arms or tabs 6, 7 are configured, in use, to deform to engage and bear against an inner surface of a hole H drilled above horizontal as the coupling member 18 is, in use, driven together with the anchor rods 11, 11' into the hole H. In this embodiment, the retainer device 1 may be formed as shown in FIG. 8 or it may alternatively be formed from steel wire (i.e., like in the embodiment of FIG. 12 or FIG. 13) with the body portion 2 wound in a helical coil 3, or two helical coils 3 as a double helix, defining a central channel 5 for receiving the tubular portion of the coupling member 18 in either a clearance fit or light interference fit to allow some translational or axial sliding movement relative thereto. The retainer device 1 is mounted on the outer periphery 20 of the coupling member 18, which has an abutment in the form of a flange 18" at its lower end presenting a shoulder 21 against which the body portion 2 of the retainer device 1 is adapted to engage or abut as the coupling member 18 is, in use, driven with the anchor rods 11, 11' into the hole H. The coupling member 18 also has a second abutment in the form of a second flange 18" at its upper end against which the body portion 2 of the retainer device 1 is adapted to engage or abut when the lower anchor rod 11' is disconnected from the drill rig. When disconnected, e.g., to connect a further anchor rod 11", the two anchor rods 11, 11' may slide down a little relative to the retainer device 1 (fixed in the hole H) under their self-weight until the shoulder 21 of the upper flange 18" engages or abuts the upper part of the body portion 2. At this point, the retainer device 1 simply holds the anchor rods 11, 11' suspended in the up-hole H.

Figure 10:
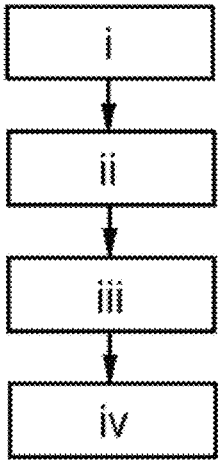
FIG. 10 is a flow diagram that schematically represents a method of installing a rock anchor according to preferred embodiments of the invention.

Finally, with reference to FIG. 10 of the drawings, a flow diagram is shown to illustrate schematically the steps in a method of installing a rock anchor in rock strata, according to the embodiments of the invention described above with respect to FIGS. 1 to 7. In this regard, the first box i of FIG. 10 represents the step of mounting a retainer device 1 on an outer periphery of an elongate anchor rod 11 of the rock anchor, the retainer device 1 having at least one arm or tab 6, 7 that projects in a direction transverse to a longitudinal extent of the anchor rod 11. The second box ii then represents the step of attaching a drill bit 12 to one end region 13 of the anchor rod 11 and rotating the anchor rod to drill the anchor rod 11 into the rock strata R to form a hole H for receiving and securing the anchor rod 11, the retainer device 1 being movable relative to the anchor rod outside of the hole H. In this regard, it will be appreciated by persons skilled in the art that the step of mounting a retainer device 1 on an outer periphery of an elongate anchor rod 11 and of attaching the drill bit 12 to the end region of the anchor rod 11 may occur simultaneously or in reverse order, before the drilling commences. The third box iii represents the step of retracting the anchor rod 11 from the drilled hole H, the retainer device 1 typically being movable relative to the anchor rod 11 outside of the hole. The fourth and final box iv in FIG. 10 of the drawings represents the step of driving the anchor rod 11 and the retainer device 1 mounted thereon into the drilled hole, H whereby the retainer device 1 is fixed or held against movement along the anchor rod 11 as the anchor rod and retainer device are driven into the hole, and whereby the at least one arm or tab 6, 7 deforms to engage and bear against an inner wall W of the hole H for retaining or holding the anchor rod in the hole.

With reference again to FIG. 10 of the drawings, the flow diagram shown can also be considered to illustrate schematically the step in a method of installing a rock anchor in rock strata according to the embodiment of the invention described above with respect to drawing FIGS. 8, 9*a* and 9*b* or drawings FIGS. 12 to 15. In this regard, as noted above, the first box i of FIG. 10 represents the step of mounting a retainer device 1 on an outer periphery of an elongate anchor rod 11 of the rock anchor having a drill bit 12 attached to a distal end region 13 thereof, the retainer device 1 having at least one arm or tab 6, 7 that projects in a direction transverse to a longitudinal extent of the anchor rod 11 and with the retainer device 1 being translationally slidable relative to the anchor rod 11 along a longitudinal extent of the anchor rod. The second box ii then represents the step of rotating the anchor rod to drill the anchor rod 11 into the rock strata R to form a hole H for receiving and securing the anchor rod 11, the retainer device 1 being movable relative to the anchor rod outside of the hole H. Again, it will be appreciated by persons skilled in the art that the step of mounting a retainer device 1 on an outer periphery of an elongate anchor rod 11 and of attaching the drill bit 12 to the end region of the anchor rod 11 may occur in any order, before the drilling commences. The third box iii represents the step of an abutment 21 provided at an opposite (i.e. proximal) end region 15 of the anchor rod 11 engaging with the retainer device 1 as the anchor rod 11 slidably advances through the channel 5 of the body portion 2 as the drilling progresses. The fourth box iv of drawing FIG. 10 thus again represents the step of driving the anchor rod 11 and the retainer device 1 mounted thereon into the drilled hole H as the drilling of the anchor rod 11 advances. That is, the body portion 2—in engagement with the abutment 21 on the coupling member 18 or collar member 18'—is driven forward by the abutment 21 (i.e. in this case without a retracting step) such that the retainer device 1 is fixed or held against movement along the anchor rod 11 as the anchor rod 11 and retainer device 1 are driven into the hole, and whereby the at least one arm or tab 6, 7 deforms to engage and bear against an inner wall W of the hole H for retaining or holding the anchor rod 11 in the hole H.

Although specific embodiments of the invention are illustrated and described herein, it will be appreciated by those of ordinary skill in the art that a variety of alternative and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other features, parts, elements or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

| List of reference signs | |
|---|---|
| 1 | retainer device |
| 1' | second retainer device |
| 2 | body portion |
| 3 | helical coil |
| 4 | wire |
| 5 | channel |
| 6 | first locking arm or tab |
| 7 | second locking arm or tab |
| 8 | cylindrical sleeve |
| 10 | rock anchor system |
| 11 | anchor rod |
| 11' | second anchor rod |
| 11" | third anchor rod |
| 12 | drill bit |
| 13 | distal end of anchor rod |
| 14 | drill rig |

-continued

| List of reference signs | |
|---|---|
| 15 | proximal end of anchor rod |
| 16 | boom |
| 17 | centraliser |
| 18 | coupling member |
| 18' | abutment member or collar |
| 18" | flange |
| 19 | interior passage |
| 20 | outer periphery |
| 21 | shoulder |
| 22 | bearing plate |
| 23 | dome washer |
| 24 | nut |
| 25 | sleeve member |
| 26 | socket cavity |
| 27 | internal thread |
| 28 | drill bit head |
| C | cavity or stope |
| R | rock strata |
| F | rock face |
| A | anchor |
| H | drilled hole |
| W | wall of hole |
| O | ore body |

The invention claimed is:

1. A retainer device for retaining or holding an anchor rod of a self-drilling anchor in a hole drilled above horizontal, the retainer device comprising:

a body portion configured to be mounted on an outer periphery or external periphery of the anchor rod; and at least one arm or tab that projects outwards from the body portion in a direction transverse to a longitudinal extent of the anchor rod, wherein the body portion is, in use, configured to engage an abutment or shoulder on the outer or external periphery of the anchor rod to prevent its movement relative to the anchor rod, and wherein the at least one arm or tab is configured, in use, to deform to engage and bear against the inner surface of the hole when the retainer device mounted on the anchor rod is driven into the hole.

2. A retainer device according to claim 1, wherein the, or each, arm or tab is elongate and projects from the body portion transversely to the longitudinal extent of the anchor rod by a distance at least equal to a diameter of the anchor rod.

3. A retainer device according to claim 1, wherein the body portion includes or defines a channel for receiving or accommodating the anchor rod and wherein an inner periphery of the channel is configured to allow translational or sliding movement longitudinally of the anchor rod in a clearance fit or a light interference fit.

4. A retainer device according to claim 1, wherein the body portion is, in use, configured for translational or sliding movement longitudinally of the anchor rod and wherein the body portion is configured to be fixed or held against translational or sliding movement along the anchor rod by engagement with the abutment or shoulder when the retainer device mounted on the anchor rod is driven into the hole.

5. A retainer device according to claim 4, wherein an abutment is provided on the outer or external periphery of the anchor rod for engagement with the body portion to prevent its translational movement along the anchor rod.

6. A retainer device according to claim 1, wherein the body portion comprises a coil or a cylinder, comprised of steel.

7. A retainer device according to claim 1, wherein the at least one arm or tab comprises a first arm or tab and a second arm or tab, wherein both the first and second arms or tabs project from the same end region of the body portion, or wherein the first and second arms or tabs project from opposite end regions of the body portion.

8. A drill bit for a self-drilling rock anchor system, the drill bit configured for attachment to an end region of an elongate anchor rod and comprising a retainer device according to claim 1 mounted thereon for retaining or holding the anchor rod in a hole drilled above horizontal.

9. A drill bit configured for attachment to an end region of an elongate anchor rod of a rock anchor system, the drill bit comprising a retainer device having at least one arm or tab that projects outwards in a direction transverse to a longitudinal extent of the anchor rod, the at least one arm or tab being configured, in use, to deform to engage and bear against an inner surface of a hole drilled by the drill bit as the drill bit is driven into the hole.

10. A drill bit according to claim 9, the drill bit comprising a socket portion configured for receiving and connecting with the end region of the elongate anchor rod, wherein a body portion of the retainer device is mounted on an outer periphery of the socket portion of the drill bit, and wherein the at least one arm or tab projects outwards from the body portion.

11. A drill bit according to claim 10, wherein the retainer device is mounted on an outer periphery of the socket portion, and the socket portion presents an abutment, which the body portion of the retainer device is configured to engage or abut.

12. A drill bit according to claim 10, wherein the socket portion presents an abutment that the body portion of the retainer device, in use, engages or abuts, wherein the body portion is located between the abutment and a drill head of the drill bit.

13. A drill bit according to claim 10, wherein the socket portion comprises an internal thread for threaded engagement with an external thread on an outer periphery of the anchor rod.

14. A rock anchor system, comprising:

a plurality of elongate anchor rods configured to be joined or coupled together in substantial axial alignment; and a drill bit according to claim 8 configured for attachment to an end region of one of the elongate anchor rods for drilling the anchor rods into rock strata.

15. A method of installing a rock anchor in rock strata, comprising steps of:

attaching a drill bit according to claim 9 to an end of an elongate anchor rod of a rock anchor; and rotating the anchor rod and the drill bit to drill the anchor rod into the rock strata to form a hole above horizontal for receiving and securing the anchor rod;

whereby as the drill bit and the anchor rod are advanced into the hole, the at least one arm or tab of the retainer device deforms to engage and bear against an inner surface of the hole for retaining or holding the anchor rod in the hole.

16. A coupling member configured for interconnecting ends of two elongate anchor rods in a rock anchor system for substantial longitudinal alignment of the anchor rods, the coupling member comprising a retainer device having at least one arm or tab that projects outwards in a direction transverse to a longitudinal extent of the coupling member or anchor rods, the at least one arm or tab being configured, in use, to deform to engage and bear against an inner surface of a hole above horizontal as the coupling member is, in use, driven with the anchor rods into the hole.

17. A coupling member according to claim 16, the coupling member comprising a hollow or tubular portion configured for receiving and connecting with end regions of the elongate anchor rods, wherein a body portion of the retainer device is mounted on an outer periphery of the hollow or tubular portion of the coupling member and wherein the at least one arm or tab projects outwards from the body portion.

18. A coupling member according to claim 17, wherein the hollow or tubular portion includes an internally threaded passage for threaded engagement with an external thread on an outer periphery of the anchor rods, wherein the retainer device is mounted on an outer periphery of the hollow or tubular portion, and wherein the hollow or tubular portion has or presents a first abutment against which the body portion of the retainer device is adapted to engage or abut as the coupling member is, in use, driven with the rods into the hole.

19. A coupling member according to claim 18, wherein the hollow or tubular portion includes a second abutment, against which the body portion is, in use, adapted to engage or abut to support the elongate anchor rods when the anchor rods are decoupled from a drilling rig.

20. A rock anchor system, comprising:

a plurality of elongate anchor rods configured to be joined or coupled together in substantial axial alignment; and at least one coupling member according to claim 16 for interconnecting ends of two of the elongate anchor rods for substantial longitudinal alignment of the anchor rods.

21. A method of installing a rock anchor in rock strata, comprising steps of:

interconnecting ends of two elongate anchor rods of a rock anchor with a coupling member according to claim 16 for substantial longitudinal alignment of the anchor rods; and drilling the anchor rods into the rock strata to form a hole for receiving and securing the anchor rods above horizontal;

whereby as the anchor rods are advanced into the hole, the at least one arm or tab of the retainer device deforms to engage and bear against an inner surface of the hole for retaining or holding the anchor rods in the hole.

22. A drill bit for a self-drilling rock anchor system, the drill bit configured for attachment to an end region of an elongate anchor rod and comprising a retainer device for retaining or holding the anchor rod in a hole drilled above horizontal, the retainer device comprising a body portion mounted on an outer periphery of the drill bit, and at least one arm or tab that projects outwards from the body portion in a direction transverse to a longitudinal extent of the anchor rod, wherein the at least one arm or tab is configured, in use, to deform to engage and bear against an inner surface of the hole when the drill bit is driven into the hole.

23. A drill bit according to claim 22, wherein the, or each, arm or tab is elongate and projects outwards from the body portion by a distance in a range of 1 to 10 times a diameter of the anchor rod.

24. A drill bit according to claim 22, wherein the body portion comprises a steel sleeve or coil.

25. A drill bit according to claim 22, wherein the at least one arm or tab comprises a first arm or tab and a second arm or tab, and wherein both the first and second arms or tabs project from opposite sides of the body portion.

* * * * *